US012215613B1

(12) United States Patent
Armstrong

(10) Patent No.: US 12,215,613 B1
(45) Date of Patent: Feb. 4, 2025

(54) SECURITY DEVICE THAT PREVENTS THEFT OF CATALYTIC CONVERTERS FROM VEHICLES

(71) Applicant: James W. Armstrong, Hauppauge, NY (US)

(72) Inventor: James W. Armstrong, Hauppauge, NY (US)

( * ) Notice: Subject to any disclaimer, the term of this patent is extended or adjusted under 35 U.S.C. 154(b) by 0 days.

(21) Appl. No.: 18/223,646

(22) Filed: Jul. 19, 2023

(51) Int. Cl.
*F01N 13/18* (2010.01)

(52) U.S. Cl.
CPC ..... *F01N 13/1822* (2013.01); *F01N 13/1855* (2013.01)

(58) Field of Classification Search
CPC .... F01N 13/1822; F01N 13/1855; F16L 3/14; B60K 13/04
USPC ..... 248/552
See application file for complete search history.

(56) References Cited

U.S. PATENT DOCUMENTS 2,489,481 A * 11/1949 Chester ..... F01N 13/1811 285/305
5,323,989 A * 6/1994 Hamada ..... F01N 13/1816 285/226
8,963,699 B2 * 2/2015 Potter ..... B60R 25/20 70/57.1
2008/0265228 A1 * 10/2008 Bosman ..... E04H 17/1439 256/1
2009/0107752 A1 * 4/2009 Dusa, II ..... F01N 13/18 180/287
2010/0101883 A1 * 4/2010 Suzuki ..... B60K 13/04 180/89.2
2011/0036130 A1 * 2/2011 Hisler ..... F01N 3/28 70/57.1
2011/0253471 A1 * 10/2011 Dusa, II ..... F01N 13/18 180/287
2022/0397215 A1 * 12/2022 Archer ..... F16L 3/137
2023/0365104 A1 * 11/2023 Richardi ..... B60R 25/1004
2024/0253594 A1 * 8/2024 Tamagni ..... F01N 13/18

* cited by examiner

*Primary Examiner* — Christopher Garft
(74) *Attorney, Agent, or Firm* — Robert J. Hess; Hess Patent Law Firm

(57) ABSTRACT

A security device to deter catalytic converter theft is a wire mesh flexible cage wrapped around a catalytic converter of a vehicle. A frame chain is secured to a vehicle frame and extends to secure to a shoulder bolt, which projects outward from a hasp tube. A shear nut is secured to a distal end of the shoulder bolt. Two fender washers may be on the shoulder bolt—one adjacent to the shear nut and the other adjacent an end of the hasp tube out of which projects the shoulder bolt. The portion of the frame chain that is secured to the shoulder bolt is sandwiched between the two fender washers. The hasp tube is part of a hasp, which has plates secured to the wire mesh of a portion of the flexible cage underneath.

15 Claims, 7 Drawing Sheets

SECURITY DEVICE THAT PREVENTS THEFT OF CATALYTIC CONVERTERS FROM VEHICLES

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to the field of vehicle catalytic converter theft deterrence.

2. Description of Related Art Including Information Disclosed Under 37 CFR 1.97 and 37 CFR 1.98

Catalytic converters are installed in virtually every motor vehicle which operates on gasoline. From small passenger vehicles through large commercial and private vehicles including trucks of all types, school buses, and recreational vehicles, if they operate on gasoline, they have a catalytic converter.

Catalytic converter theft has been increasing for several years due to the use of expensive, relatively rare metals including platinum, rhodium, and palladium. These metals are sourced from a limited number of areas around the world-currently much from South Africa. The COVID 19 pandemic had a major impact on the production of these metals and as a result, their value has increased significantly since 2020.

Along with the high values for these metals, catalytic converter theft has been greatly facilitated by the wide availability of lightweight, highly portable, inexpensive, battery powered, reciprocating and rotary saws. An experienced operator can use these tools to cut a catalytic converter out of a vehicle in under two minutes. This requires the cutting of two thin pipes connected to the catalytic converter and cutting the oxygen sensor wire. The catalytic converter is then easily removed. Due to their size and weight, one person can readily carry the catalytic converter to a waiting vehicle, along with the tools. In some cases, a small hand jack is used to raise the vehicle some.

Once a catalytic converter is removed from a vehicle, the vehicle is essentially rendered inoperable. Emissions controls systems may not allow the vehicle to even start and if it does start, it will be very loud. Replacement typically requires a visit to a mechanic shop and loss of the use of the vehicle for up to several days. In most cases, the replacement will be covered by insurance as long as the owner has comprehensive coverage including theft. If not, the owner will have to pay for the replacement.

There are efforts underway to require all catalytic converters be stamped with numbers matching the VIN for the vehicle and any processing facility will have access to the numbers as part of stolen vehicle/parts databases. The processors should turn away these catalytic converters and ideally report the person(s) who brought them to the facility. However, even if this is done by legitimate recycling facilities, the high value of these metals makes it reasonable to expect that illicit recycling operators will replace the legitimate operators who will not take stamped converters. There will still be demand and the relative ease of catalytic converter theft will make this an ongoing problem for some time. No vehicles currently have stamped catalytic converters, and these will still be targets even if converters do get stamped at some point in the future.

Given the high value of the metals used in catalytic converters, stamping of catalytic converters will not deter their theft and processing in illicit/underground facilities, even if legitimate recycling facilities will no longer process them. As long as the value of the metals remains high and the theft of the converters remains easy, it will continue.

Catalytic converter thieves must operate quickly since the process of cutting out converters is noisy. An experienced crew of thieves can remove a converter in less than two minutes and in many cases in less than a minute. A device that makes catalytic converter removal more difficult and time consuming will be effective in deterring thefts by making the protected converter less attractive as a target.

There are numerous catalytic converter security and theft deterrent systems available using a variety of approaches to deter converter thefts. There are also informal videos by various parties of tests of some of these devices. Typically, such converter theft deterrent systems on the market are considered to be "do it yourself" (DIY) systems. However, the people stealing catalytic converters are for the most part experienced and well-equipped individuals or teams. The inexpensive, conventional "DIY" approach is not going to deter or thwart such experienced and well-equipped individuals or teams.

For instance, a commercially available product under the product name Cat Strap uses a group of steel cables housed inside a fiberglass sleeve that is clamped and bonded to the converter and adjacent exhaust pipes. The strap is intended to deter cutting of the pipes and make removal of the converter more difficult due to the bonding of the catalytic converter to the strap sleeve. The multiple steel cables inside the sleeve prevent cutting with a reciprocating saw and slows down the theft of the converter. At least one informal test video of different converter theft prevention devices showed that Cat Strap required more time to cut through compared to the bare exhaust pipes. There are issues with this device including the odor of the bonding material when the vehicle is initially operated and the bonding material melts to the converter. This is intended to be a do-it-yourself installation.

Strap-on or otherwise connected alarm devices are available as converter theft deterrent devices. These are typically connected to adjacent exhaust pipes and are intended to sound an alarm and set off a strobe light when disturbed by theft activity. These are relatively inexpensive and a do-it-yourself installation. One model observed in a video was cut off the pipe and crushed in a few seconds and only sounded an alarm for 30 seconds when it was allowed to function as intended. A key issue with alarm devices is that car alarms in general do not get much attention when they go off. Alarms for converters are not likely to get that much attention or will be disabled or destroyed quickly by an experience thief with a battery reciprocating saw.

There is a catalytic converter theft prevention device that utilizes fabricated metal collars on each end of the converter with a series of thick stainless-steel cables that connect the collars to each other and to the frame of the vehicle. The device was the most effective in slowing down attempted theft in the demonstration video and is marketed as a do-it-yourself device. One significant issue with this device is the extensive length of cable used and securing it to the frame. The device also provides one line of defense-cutting the frame connection cable will allow the converter to be cut from the pipes and removed.

Custom security plates are one of the commercially available converter theft deterrent devices. Cages made of steel rods are also available for vehicles such as larger truck-based vehicles. These are custom made for a specific vehicle model and are usually bolted to the undercarriage of the vehicle to prevent cutting of the exhaust pipe connected to the converter and to prevent or slow removal of the converter. The plate devices could potentially be removed using battery driven ratchets or lug wrenches. However, the noise, potential difficulty in accessing the bolts, and the extended time to remove the plate or cage are clearly deterrents.

It is therefore desired to deter theft of a catalytic converter by making removal of the catalytic converter as difficult and time consuming as for such custom security plates and cages if not more so and yet be more universal rather than specific to a particular vehicle model. Preferably, the security device provided deters theft, because would-be thieves would need to cut through multiple components to remove the catalytic converter. Such a laborious, time-consuming, and noisy effort may deter would be thieves from seeking to steal the catalytic converter that is protected against theft by such a security device.

BRIEF SUMMARY OF THE INVENTION

One aspect of the invention relates to a security device that deters catalytic converter theft from vehicles by enclosing the catalytic converter in a mini-mesh wire cage and securing the cage to the vehicle frame with attachment hardware including at least one security chain. The mini mesh may be a security mesh of a type used for security around sensitive areas and prisons. With such a security device in place, thieves would need to cut through multiple components to gain access to the catalytic converter for removal and the process for doing so is both more time consuming and noisy.

The security device in accordance with the invention can be installed by persons with mechanical skills and ability to access the underside of a vehicle, even without the vehicle being raised such as with a lift. In other words, professional skilled mechanics who work on repairing vehicles for their livelihood.

The security device in accordance with the invention provides no single point of breach of security-cutting or otherwise compromising one component will not allow the catalytic converter to be removed. Components of the security device are designed to protect each other from the tools and methods used by converter thieves. The components provide redundant layers of mutual protection between the components with the main goal of creating a situation of it becoming simply too difficult, time consuming, noisy, and just generally aggravating and frustrating for thieves to try to get through to remove the catalytic converter from the vehicle. In that sense, the security device does not suffer from a single component vulnerability. The components that provide redundant security include a flexible cage, shoulder bolts, shear nuts, hasps, and frame chain cables.

BRIEF DESCRIPTION OF THE DRAWING

For a better understanding of the present invention, reference is made to the following description and accompanying drawings, while the scope of the invention is set forth in the appended claims.

DETAILED DESCRIPTION OF THE INVENTION

Figure 1:
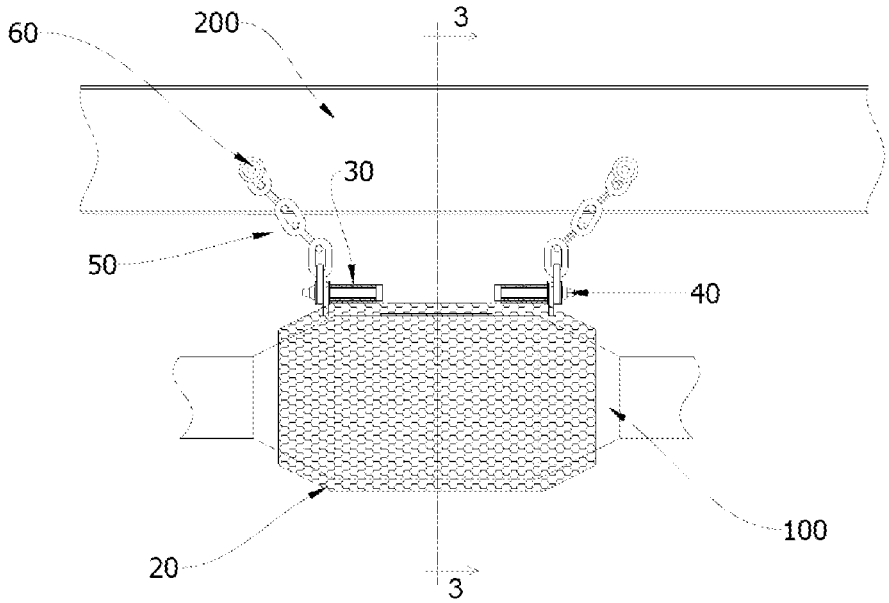
FIG. 1 is a side view of a security device in accordance with an embodiment of the present invention whose flexible cage wraps around a catalytic converter and is secured to a vehicle frame via two frame chains or cables, each attached to respective hasp tube and adjacent shear nuts that are positioned face away from each other. Hasp assembly orientation can be varied as needed for the installation. The orientation shown in FIG. 1 exemplifies the typical installation.
Figure 2:
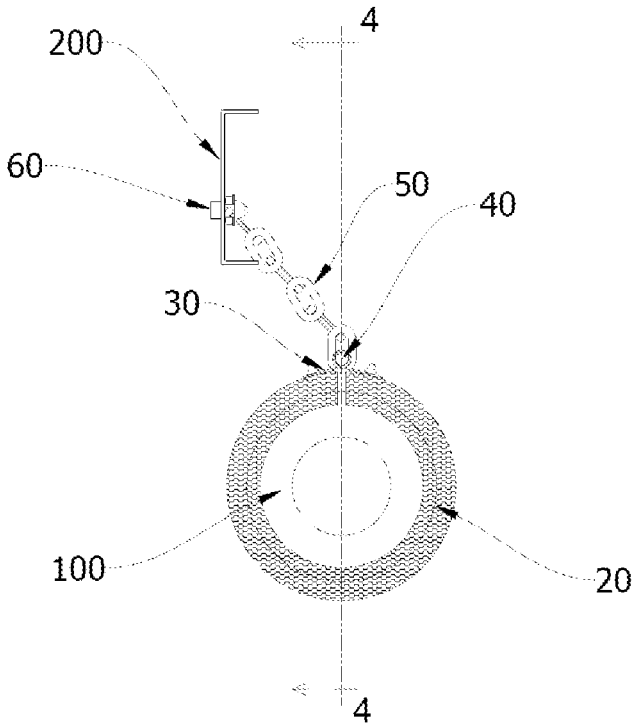
FIG. 2 is an end view of the embodiment of FIG. 1.
Figure 3:
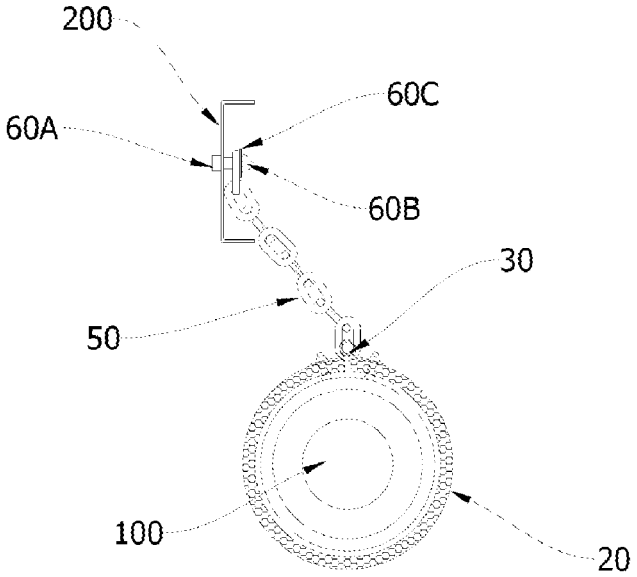
FIG. 3 is a cross-section of section 3-3 of FIG. 1.
Figure 4:
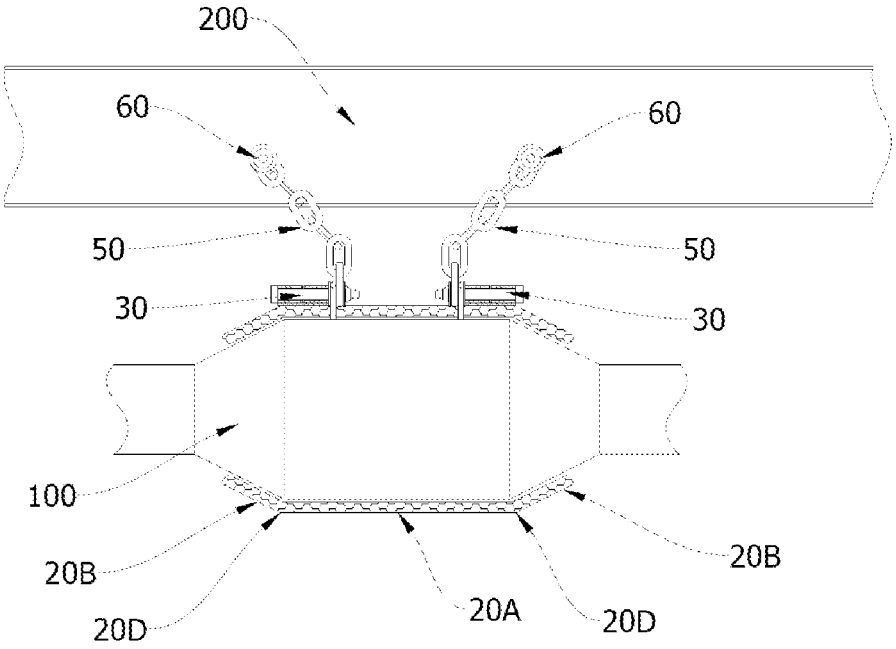
FIG. 4 is a cross section view of section 4-4 of the security device in accordance with a further embodiment of the present invention whose flexible cage wraps around a catalytic converter and is secured to a vehicle frame via two frame chains or cables each attached to respective hasp tube and adjacent shear nuts that are positioned face each other. Hasp assembly orientation can be varied as needed for the installation. The orientation shown in FIG. 1 exemplifies the typical installation.
Figure 6:
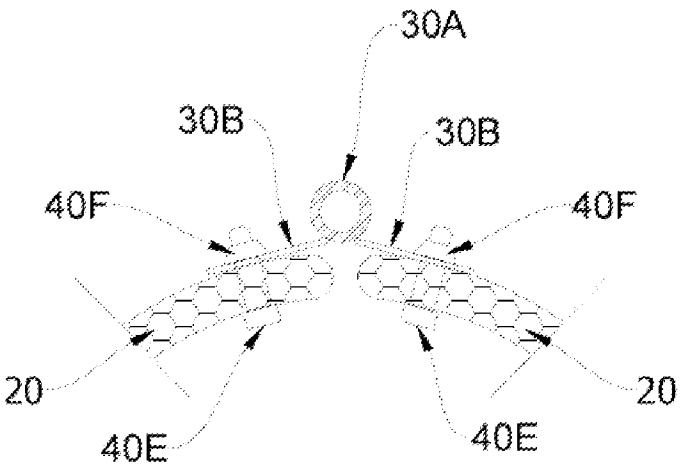
FIG. 6 is a side view of the one of the hasps of FIG. 5.
Figure 5:
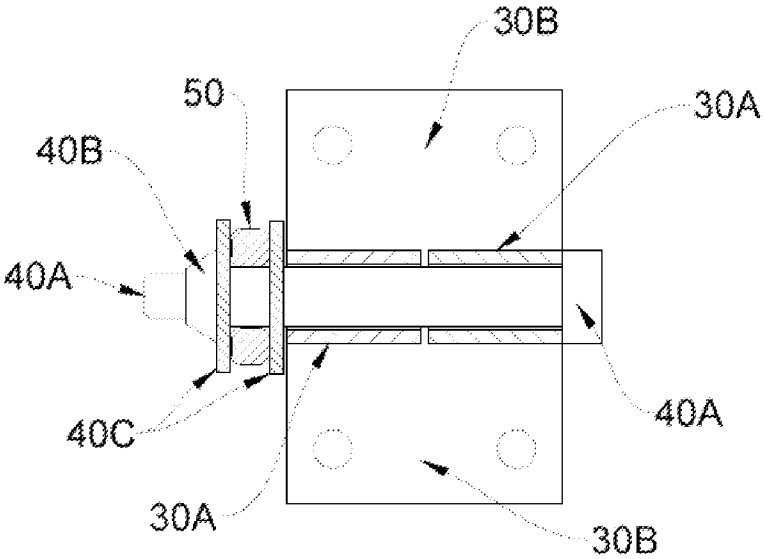
FIG. 5 is a top view of one of the hasps of FIG. 1, which is symmetric to the other of the hasps.
Figure 7:
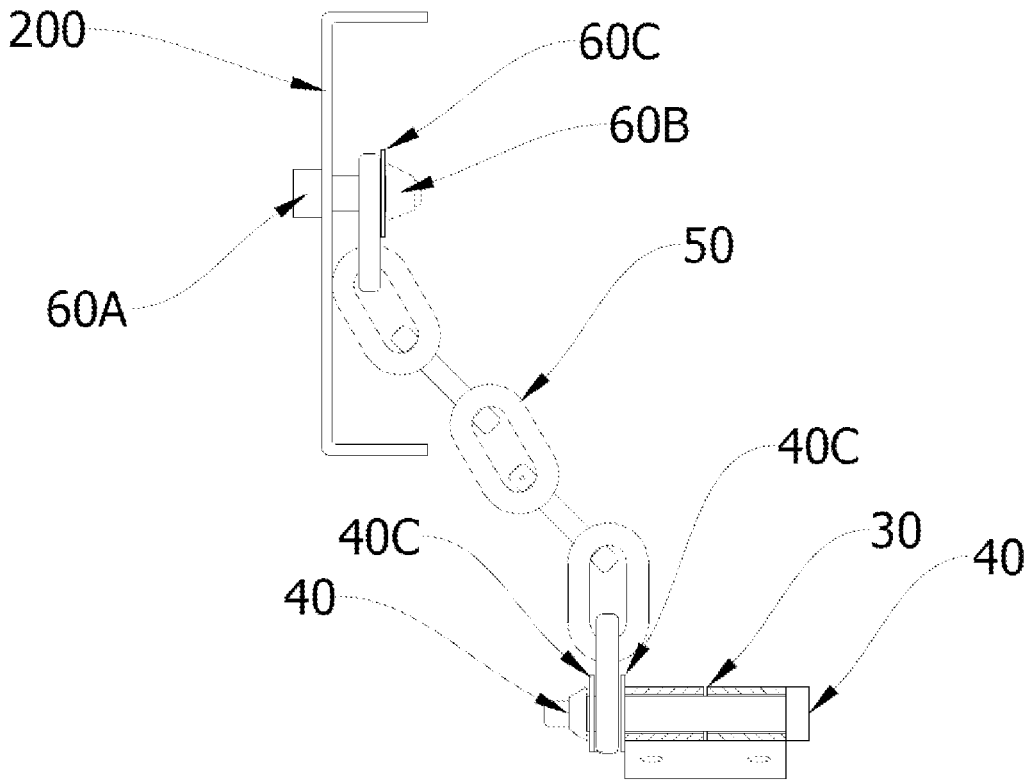
FIG. 7 is a side view of an assembly of hardware of the security device of FIG. 1 without the flexible cage that is associated with one of the hasps and one of the frame chain cables.

An attractive target for catalytic converter theft is the vehicle segment based on the commercial truck chassis. This includes vehicles such as RVs, school buses, and "box" trucks. Such a vehicle segment is an attractive target for catalytic converter theft because of their use of larger converters as compared to those for passenger vehicles and because access to the catalytic converter under the vehicle with the cutting tools used by thieves is easier than lower height passenger vehicles.

Turning to the figures, the security device 10 is shown in accordance with the invention and whose concept was initially developed in November of 2022 from ideas developed through discussions with Joe Divilio, the owner of an autobody and vehicle mechanical repair shop, Perfect Bodies Autobody (PBAB) in Bohemia, NY. PBAB also provides repair services for recreational vehicles (RVs) and campers, including some RVs from which catalytic converters had been stolen. Additionally, other contact Mr. Divilio has with local law enforcement had been discussing the high number catalytic converter thefts that were being reported on a variety of vehicles including the larger commercial chassis-based vehicles such as RVs. Mr. Divilio also reported from another professional contact that over twenty catalytic converters were stolen from a school bus company in Hauppauge, New York.

PBAB customer RVs were used to test prototypes of the security device 10 and also to prevent thefts of the catalytic converters 100 from customer vehicles while at PBAB. Before the prototype test units were fabricated and installed, all of the customer RVs had to be squeezed into the garage space overnight and on weekends to prevent thefts. Since use of the prototypes of the security device 10, the RVs are again able to be parked outside. There have been no thefts of catalytic converters 100 on any with the prototype Cat Keepers installed that the present inventor is aware of. In addition to being effective at deterring theft by making it physically difficult and time consuming, the security device 10 has an intimidating appearance, readily visible when looking under the vehicle. It is very clear that this will be a challenging theft. Catalytic converter thieves are not interested in overcoming challenges-they want fast and easy targets.

Based on the general concepts of what will be an effective theft deterrent and inspection of a number of typical RV and other commercial vehicle converters, the security device was developed based on the use of a mesh or net of some sort as the primary component to provide a flexible "cage" that will make cutting difficult and require cuts of many of the wires comprising the mesh. The idea of using micro mesh came from observation of the material in use for high security fences around Long Island railroad stations and correctional facility fences. Micro mesh is also used for a security enclosure for the natural gas connections for the Intrepid Museum, which is in New York city and is a client of the present inventor's engineering consulting firm, DSM Engineering.

The security device 10 of the present invention was conceived to include a flexible cage 20, hasps 30, hasp connection hardware assembly 40, a frame chain 50 and frame connection hardware assembly 60. The flexible cage 20 includes a central cylindrical region 20A, two tapering regions 20B that converge away from the central cylindrical region 20A to terminate at respective opposite ends 20C, and two bends 20D that transition the central cylindrical region 20A to the tapering regions 20B. The flexible cage 20 is made of wire mesh.

The hasps 30 each include a hasp tube 30A attached to a hasp plate 30B in a symmetric manner. The hasp connection hardware assembly 40 includes shoulder bolts 40A shear nuts 40B and fender washers 40C (optional). The frame chain 50 is steel chain the length of which varies based on the vehicle installation. The frame connection hardware assembly 60 includes frame bolts 60A, shear nuts 60B and washers 60C.

The security device 10 deters catalytic converter theft by wrapping the wire mesh flexible cage 20 around a catalytic converter 100 of a vehicle. The frame chain 50 is secured to a vehicle frame 200 and extends to secure to the hasp bolt 40A, which projects outward from the hasp tube 30A. The shear nut 40B is secured to a distal end of the shoulder bolt 40A. Two fender washers 40C may be on the shoulder bolt-one adjacent the shear nut 40B and the other adjacent an end of the hasp tube 30A out of which the shoulder bolt 40A projects. The portion of the frame chain assembly 50 that is secured to the shoulder bolt 40A is preferably sandwiched between the two fender washers 40C, although the fender washers 40C are optional so if there are no fender washers 40C, the frame chain portion is sandwiched between the shear nut 40B and an end of the hasp tube 30A. The hasp tube 30A is part of the hasp 30 whose plates 30B are secured to the mesh of the flexible cage 20 using shoulder bolts 40E and shear nut 40F. The flexible cage 20 is sandwiched between the heads of shoulder bolts 40E and the hasp plate 30B and shear nuts 40F mesh to secure the hasp assembly 30 to the mesh 20. Bolt configuration and locations are variable and determined by the vehicle installation requirements. This is the typical assembly but other attachment methods for securing the hasp assembly to the mesh may be used including regular carriage bolts, nuts, and rivets.

The initial prototypes for the flexible cage 20 did not have bends 20D for the mini mesh. It became evident that this construction (without the bends 20D and tapering regions 20B) would not be effective to deter theft because individual wires could be cut at the ends and then unwound from the mini mesh of flexible cage 20. As a result of such cutting, the mini mesh split in two pieces, which rendered the flexible cage 20 ineffective in protecting the catalytic converter 100 against theft. The bends 20D create the tapered regions 20B of the micromesh and make the flexible cage 20 conform to the general shape of the catalytic converters 100. The bends 20D and tapered region make removing catalytic converters more difficult and prevent unwinding of the individual wires in the flexible cage.

Any commercial or larger vehicle that is not diesel fueled can have its catalytic converter 100 protected against theft with the security device 10 of the present invention. Truck chassis-based vehicles will typically use standard sizes and installation configurations for the catalytic converters 100 to which are readily applied the security devices 10 in accordance with the present invention. The security device 10 will also be used on passenger vehicles where installation is practical through variation in the device 10 size and connection configuration adapted to the vehicle.

The main component in security device 10 is the flexible cage 20 preferably made of mini mesh. Mini mesh is basically chain link fence with a very small space between the adjacent wires. The mini mesh preferably is no larger than ½" spacing. Spacings of ⅜" and ¼" may be used depending on the application and security level required by the application. Preferably, the minimum wire thickness for the wire of the mini mesh is 9 gauge. Typically, 6-gauge wire and is either bare steel wire or galvanized wire. No painted or coated wire can be used due to the temperatures of catalytic converters in operation.

Mini mesh is also available in a variety of wire thicknesses. Thicker wire along with the small mesh gap make the flexible cage 20 very difficult to cut. It cannot be cut with bolt cutter or regular wire cutters because the small mesh gap and thick wire prevent use of these tools. The cage design makes it necessary to cut a large number of the individual wires before the security integrity of the flexible cage 20 becomes compromised.

Further, the mini mesh is not easily cut with reciprocating saws that are the preferred tool of catalytic converter thieves. The individual wires can move and make cutting with a reciprocating saw blade very difficult and time consuming. The mesh wire can be cut with battery drive rotary tools, but this requires a significant amount of time, generates a lot of noise, and generates a lot of sparks. In the relatively constrained space under a vehicle, cutting enough of the mesh wires to reduce the integrity of the cage will not be possible for a thief trying to do the job quickly and relatively quietly.

The bends 20D required development of fabrication methods and equipment to bend the mesh without altering its length and maintaining its flexibility for wrapping around the converter. The bends 20D are each of varying position and degree as required for different catalytic converter sizes and configurations. Changes to the bends 20D will vary the sizes of the central region 20A and the tapered region 20B to conform to individual catalytic converters 100.

The bending of the mini mesh tapers the flexible cage 20 to form the tapered regions 20B and thus follows the tapering of typical catalytic converters 100 from their main body diameter to the connection with the adjacent exhaust pipes. The mini mesh preferably does not need to taper all the way to the connected pipes and is thus sized accordingly. The bending of the mini mesh wires prevents their removal that might otherwise occur via unwinding them from the mini mesh.

Figure 9:
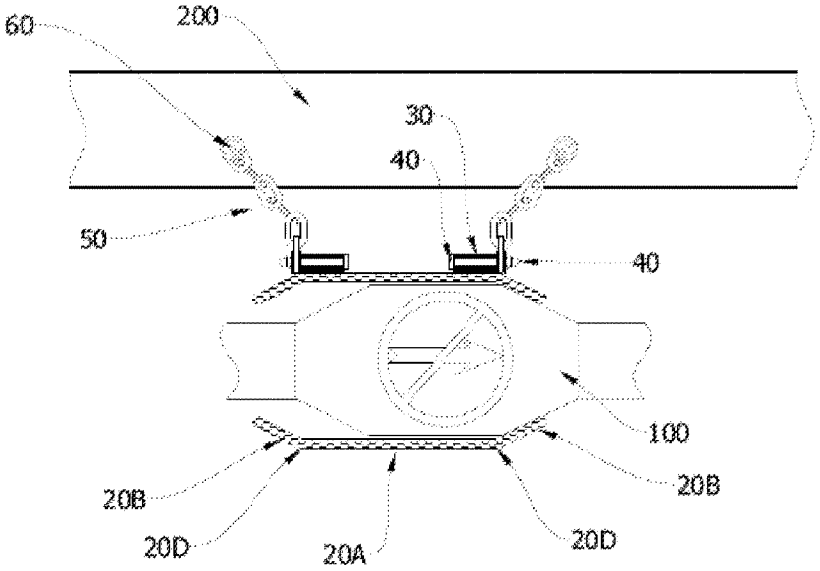
FIG. 9 is a side view of a catalytic converter being blocked from removal by the tapered ends of the flexible cage.
Figure 8:
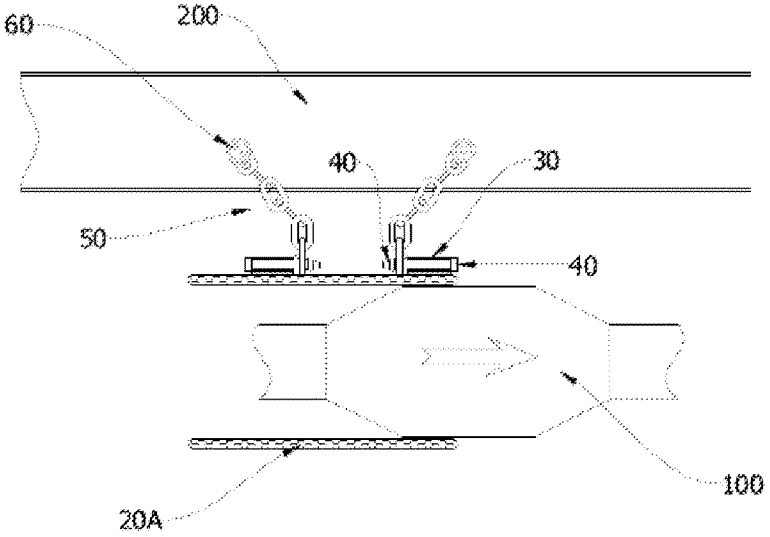
FIG. 8 is a side view of a catalytic converter being removed from a flexible cage that lacks tapered ends.

Without the bends 20D, individual wires can be unwound, which would compromise the flexible cage 20 as a theft deterrent completely. This is because the tapering regions 20B of the flexible cage 20 prevents removal of the catalytic converter 100, which prevention is shown in FIG. 9, that might otherwise occur by sliding it through one end 20C or the other 20C of the flexible cage 20, which sliding removal is shown in FIG. 8. Other components in the hardware assembly of the invention will also prevent removal of the catalytic converter 100 from the flexible cage 20 even without reliance on the bends 20D. In addition, the tapering regions 20B of the flexible cage 20 reduce the possibility of the security device 10 getting snagged on something the vehicle is passing over.

The flexible cage 20 is wrapped around the catalytic converter 100. Two portions of the central cylindrical region 20A of the mini mesh of the flexible cage 20 that neighbor the bends 20D respectively are secured using the hasps 30 and the hasp connection hardware 40. The shoulder bolts 40A and shear nuts 40B of the hasp connection hardware 40 are preferably made of steel and in effect constitute theft deterrent tamper-proof bolts and nuts.

When the flexible cage 20 is wrapped around the catalytic converter 100, hasp tubes 30A accommodate passage therethrough of a shoulder bolt 40A for locking the hasps 30 together. Further, additional shoulder bolts 40E and shear nuts 40F fasten the hasp 30 to the flexible cage 20 and therethrough to the hasp connection hardware 40.

The hasps 30 and the shoulder bolts 40A also secure the frame chain 50, which in turn connects the flexible cages 20 and hasps 30 to the vehicle frame 200.

The shoulder bolts 40A slide through the hasp tubes 30A and will be secured in place using the shear nuts 40B. The shear nuts 40B are manufactured to shear off once the nut is tightened to the shoulder bolt 40A, leaving a smooth domed section in place that cannot be removed with wrenches or tools such as channel locks. Once in place, the shear nuts 40B need to be cut off and this will not be practical due to the inaccessibility of the shear nuts 40B to cutting tools once in place, further inhibited if the optional adjacent heavy-duty fender washers 40C are installed.

The shoulder bolts 40A are used so that the shear nuts 40B can be tightened down without causing the additional components, namely, the hasps 30, the frame chain 50, or the fender washers 40C to be clamped tightly. These additional components also protect the shoulder bolts 40A and shear nuts 40B from being cut directly. The optional dual fender washers 40C on each end of the shoulder bolts 40A just under the head of the shoulder bolts 40A and the shear nuts 40B are wide enough that they will block the use of a reciprocating saw or rotary saw from cutting the bolts and nuts. Because the fender washers 40C are not clamped tightly due to use of the shoulder bolts 40A, they will rotate and otherwise not provide a firm cutting target. Again-all these are intended to frustrate the thieves.

The hasps 30 are secured to the flexible cage 20 using the additional shoulder bolts 40E and the additional shear nuts 40F. The heads of the shoulder bolts 40E are on the inside of the mesh and are too large to be pulled through the heavy mesh wiring. Optional fender washers 40C are also used under the head of the shoulder bolts 40E to further frustrate pulling the bolts through the mesh. Shear nuts 40F are used on the outside of the two hasp plates 30B and are designed to shear off when installed, leaving a rounded dome that cannot be removed by wrenches or tools such as channel locks. They will have to be cut off. Each of the two hasp plates 30B are preferably attached with at least two shoulder bolts 40E and shear nuts 40F, although a single shoulder bolt 40E and a single shear nut 40F instead of a pair of them may be used. Removal of the hasp 30 will require at least two of the bolt/nut assemblies be cut on each end. The use of the shoulder bolts 40E will allow the shear nuts 40F to spin with the shoulder bolts 40E if a tool such as a reciprocating saw is used to cut them. This will slow the cutting process considerably, adding to the time and frustration in removing the security device 10.

Figure 10:
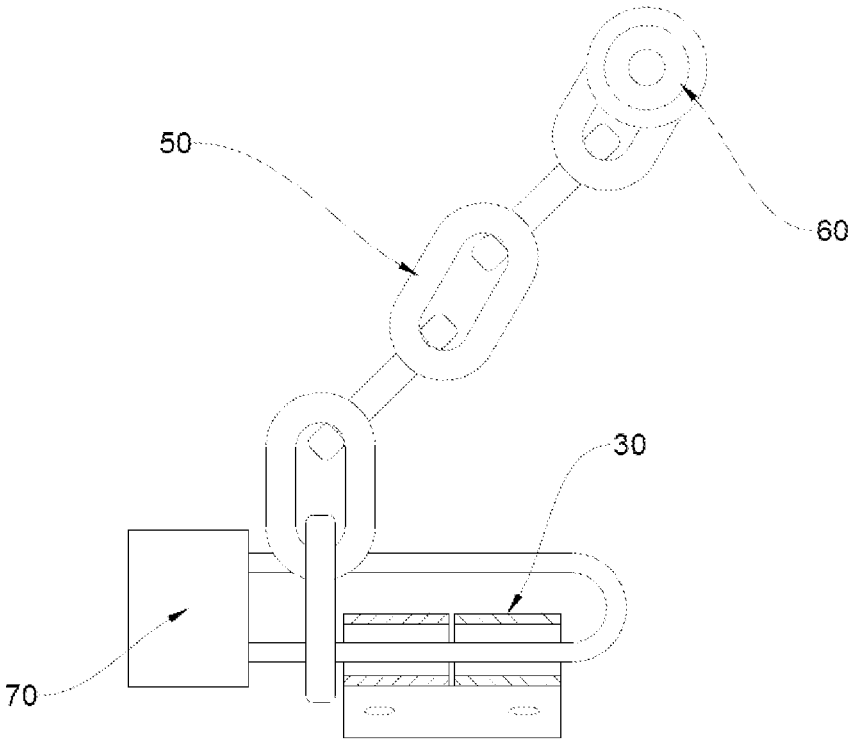
FIG. 10 is a side view of a further embodiment showing a frame chain secured to the hasp with a padlock in place of the shoulder bolt and shear net.

Locking bolts that are normally used for securing trailer hitches are an alternative means of securing the hasps and are expected to be used in temporary security device installation in service facilities. The size of the hasp tubes is such that the locking bolts can be accommodated if a customer wished to do so. FIG. 10 shows the use of a padlock 70 in place of the connection assembly of bolts and shear nuts 40.

The frame chain 50 preferably is security chain of hardened steel to secure the flexible cage 20 and the catalytic converter 100 to the vehicle frame 200. The steel of the security chain sections is hardened to prevent cutting with tools such as bolt cutters. Security chain can be cut using a rotary tool, but this is time consuming and will likely require cutting blade changes. The chains cannot realistically be cut with a reciprocating saw. Two chains are preferably used on each installation of the security device 10 and both will have to be cut to remove the flexible cage 20 and the catalytic converter 100. This is possible but the time required and the wear of tools such as a rotary cutter will be significant deterrents to theft.

The connection of each chain to one of the hasps 30 is done using the assembly of the shoulder bolts 40A and shear nuts 40B. The end link of each frame chain 50 is connected to the hasp 30, which also provides protection to the assembly of the shoulder bolt 40A and hasp 30—cutting these requires maneuvering tools past the link of the frame chain 50.

Connection of the frame chain 50 to the vehicle frame 200 is done using a frame connection hardware assembly 60, which includes frame bolts 60A and shear nuts combined with optional heavy-duty washers to prevent cutting of the frame chain 50 at the frame bolts. The use of shear nuts and tamper proof bolt heads or tamper proof covers over the bolt heads of the frame bolts 60A add to the difficulty in cutting the frame connection hardware assembly 60. These will also be in locations that will be challenging to access with battery powered cutting tools and in the constrained space under the vehicle, making cutting the frame bolt assemblies and chain links very difficult and time consuming.

The frame chain 50 will be secured as much as practical inside frame components using stainless steel zip ties. Any attempt to cut the frame chain 50 will have to be done on the exposed section from the frame to the flexible cage 20, which will be loose and the frame chain 50 will be more challenging to hold stationary for use of power cutting tools.

A considerable amount of the development of the security device 10 was required in developing a bending device and techniques for bending the mini mesh of the flexible cage 20. The mini mesh is very difficult to cut to various sizes and for the end bending due to the strength of the many individual wires. It was determined from initial bending attempts that the mini-mesh has to be bent in a manner that preserves its initial width—otherwise it will be too small or extra mesh will be required for a given catalytic converter.

After several different bending techniques and equipment combinations were used, the current design of the mini mesh bender was developed. The current version of the bender uses a pneumatic/hydraulic cylinder to rotate a piece of steel angle against the mini mesh, which is secured in place by a second stationary steel angle. As the rotating steel angle is rotated by the cylinder, it forces the mesh to bend against the stationary channel, bending the mesh to the desired angle. The angle can vary for different models of catalytic converters and the bending system will accommodate varying widths of mesh for different catalytic converters.

Another focus of the development effort has been the hasps 30 and locking hardware. Several different prototypes for the hasps 30 were tried including some made from available hinge assemblies and others fabricated from flat steel. The current design provides a cut-resistant assembly that can accommodate padlocks with long hasps or trailer hitch pin locks up to ½" in diameter. The use of a padlock 70 instead as the hasp hardware is shown in FIG. 10. The padlock 70 has a U-shaped shackle with one leg of the U-shape extending though the tube 30A of the hasp 30 and the other leg remaining outside the tube 30A to in effect lock the padlock 70 to the hasp 30 when the free end of the U-shape shackle is inserted into an opening in the base of the padlock that locks the shackle free end inside. A frame chain 50 is secured to shackle preferably in the region between the tube and the locking base of the padlock 70. Padlocks and trailer pin locks are readily available from numerous suppliers. These are expected to be used for temporary Cat Keeper installations such as in service centers to protect client vehicles while being serviced as has been done with the prototypes at PBAB on client RVs.

The same design for the hasp 30 may be used for permanent installations which will use shoulder bolts and tamper resistant shear nuts. These are not intended to be removable, but in a shop setting with appropriate tools and time, they can be cut from the vehicle to service or replace a catalytic converter 100. However, other than theft or damage, catalytic converters do not typically require replacement and may last for the life of a vehicle. The increased effort to service a converter with a security device 10 installed is a small tradeoff for not having to replace a stolen catalytic converter 100.

Figure 12:
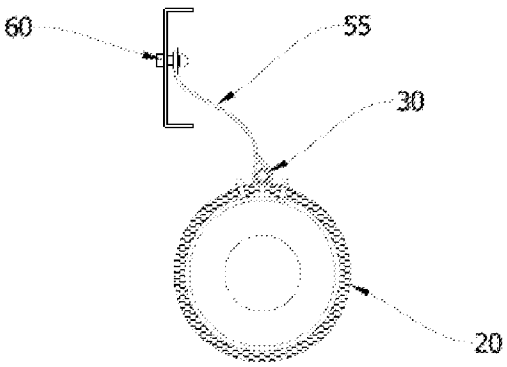
FIG. 12 is a side view of a further embodiment showing the use of a cable 55 in place of the frame chain.
Figure 11:
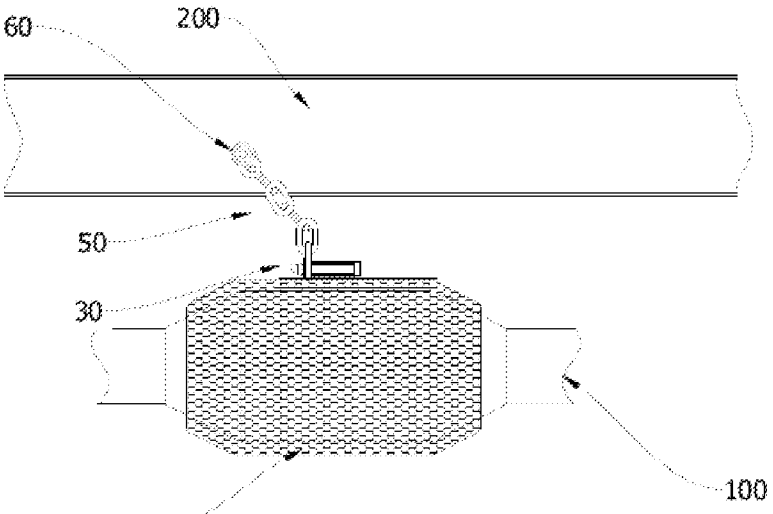
FIG. 11 is a side view of a further embodiment showing a single hasp and frame chain installation.

The preferred embodiment uses the steel frame chain 50. An alternative to the frame chain 50 is a heavy-duty steel cable 55, looped at both ends, which embodiment is shown in FIG. 12. The cable 55 may be used in installations where use of the chain 50 is not desired or is not practical depending on vehicle configuration and owner preference.

While the foregoing description and drawings represent the preferred embodiments of the present invention, it will be understood that various changes and modifications may be made without departing from the scope of the present invention.

What is claimed is:

1. A security device to deter catalytic converter theft, comprising:

a flexible cage having a central cylindrical region and two tapering regions, the two tapering regions terminating at opposite ends respectively, the flexible cage being of wire mesh and having two bends transitioning the central cylindrical region to respective ones of the two tapering regions;

at least one hasp;

at least one frame chain;

hasp hardware associated with the at least one hasp that connects the at least one frame chain to the at least one hasp; and frame hardware to which is secured the at least one frame chain, the hasp hardware and the frame hardware being separated from each other by the at least one frame chain, wherein the hasp includes a tube and two plates extending from the tube, the hasp hardware including a shoulder bolt having a shaft and a head, the shaft extends from within the tube to project outward from the tube, and at least one frame chain being connected to a portion of the shaft that projects outward from the tube.

2. A security device to deter catalytic converter theft, comprising:

a flexible cage having a central cylindrical region and two tapering regions, the two tapering regions terminating at opposite ends respectively, the flexible cage being of wire mesh and having two bends transitioning the central cylindrical region to respective ones of the two tapering regions;

at least one hasp;

at least one frame chain;

hasp hardware associated with the at least one hasp that connects the at least one frame chain to the at least one hasp; and frame hardware to which is secured the at least one frame chain, the hasp hardware and the frame hardware being separated from each other by the at least one frame chain, wherein each of the hasp hardware and the frame hardware include at least one shoulder bolt having a shaft and a head, the at least one frame chain being connected to the shaft of the at least one shoulder bolt of the hasp hardware and to the shaft of the at least one shoulder bolt of the frame hardware.

3. The security device of claim 1, wherein the hasp hardware includes two optional washers and a shear nut, wherein one of the two washers is adjacent to the shear nut and another of the two washers is adjacent to an end of the tube, the at least one frame chain extending between the two washers and connected to the portion of the shaft that projects outward from the tube.

4. The security device of claim 1, wherein the hasp hardware includes a shear nut, the frame chain extending between the shear nut and an end of the tube and connected to the portion of the shaft that projects outward from the tube.

5. The security device of claim 1, wherein the hasp hardware includes at least two shoulder butts bolts and two shear nuts, each of the two plates having at least one opening into which is a shaft of a respective one of the two shoulder bolts, the shaft of each of the two shoulder bolts having an end at which is secured a respective one of the two shear nuts, each of the shoulder bolts having a head that is wider than the shaft, the flexible cage having a portion extending between the two plates and the head of each of the two shoulder shafts, the wire mesh of the flexible cage having mesh spacings accommodating the shaft therein that are smaller in size than widthwise dimensions of the head.

6. The security device of claim 5, wherein the hasp hardware includes a washer abutting the head and fitted onto the shaft, the washer having a widthwise dimension that is wider than the head.

7. A security device to deter catalytic converter theft, comprising:

a flexible cage having a central cylindrical region and two tapering regions, the two tapering regions terminating at opposite ends respectively, the flexible cage being of wire mesh and having two bends transitioning the central cylindrical region to respective ones of the two tapering regions;

at least one hasp;

at least one frame chain;

hasp hardware associated with the at least one hasp that connects the at least one frame chain to the at least one hasp; and frame hardware to which is secured the at least one frame chain, the hasp hardware and the frame hardware being separated from each other by the at least one frame chain, wherein the hasp includes a tube and two plates extending from the tube, the hasp hardware including a shackle of a padlock that extends from outside the tube to within the tube, the at least one frame chain being secured to shackle outside the tube.

8. A security device to deter catalytic converter theft, comprising:

a flexible cage having a central cylindrical region and two tapering regions, the two tapering regions terminating at opposite ends respectively, the flexible cage being of wire mesh and having two bends transitioning the central cylindrical region to respective ones of the two tapering regions;

at least one hasp;

at least one frame chain;

hasp hardware associated with the at least one hasp that connects the at least one frame chain to the at least one hasp; and frame hardware to which is secured the at least one frame chain, the hasp hardware and the frame hardware being separated from each other by the at least one frame chain, a catalytic converter, the flexible cage being wrapped around the catalytic converter, the tapering regions of the flexible cage being in a relative location that blocks the catalytic converter from being able to slide through either of the opposite ends of the flexible cage.

9. A security device to deter catalytic converter theft, comprising:

a plurality of components that are configured and arranged to provide redundant layers of mutual protection as a deterrent against catalytic converter theft, the components including a flexible wire mesh cage, at least one hasp, hasp hardware, at least one frame chain, and frame hardware, the flexible cage having a central cylindrical region and two tapering regions, the two tapering regions terminating at opposite ends respectively, the flexible cage being of wire mesh and having two bends transitioning the central cylindrical region to respective ones of the two tapering regions, the hasp hardware and the frame hardware each including at least one shoulder bolt having a head and a shaft and at least one shear nut connected to an end of the shaft, the at least one frame chain being connected to the shaft of the shoulder bolt of the hasp hardware and to the shaft of the shoulder bolt of the frame hardware, wherein the hasp includes a tube and two plates extending from the tube, the shaft of the shoulder bolt of the hasp hardware extending from within the tube to project outward from the tube, and the at least one frame chain being connected to a portion of the shaft that projects outward from the tube.

10. The security device of claim 9, wherein the hasp hardware includes two washers and a shear nut, wherein one the two washers is adjacent to the shear nut and another of the two washers is adjacent to an end of the tube, the at least one frame chain extending between the two washers and connected to the portion of the shaft that projects outward from the tube.

11. The security device of claim 9, wherein the hasp hardware includes a shear nut, at least one frame chain extending between the shear nut and an end of the tube and connected to the portion of the shaft that projects outward from the tube.

12. The security device of claim 9, wherein the hasp hardware includes at least two shoulder butts bolts and two shear nuts, each of the two plates having at least one opening into which is a shaft of a respective one of the two shoulder bolts, the shaft of each of the two shoulder bolts having an end at which is secured a respective one of the two shear nuts, each of the shoulder bolts having a head that is wider than the shaft, the flexible cage having a portion extending between the two plates and the head of each of the two shoulder shafts, the wire mesh of the flexible cage having mesh spacings accommodating the shaft therein that are smaller in size than widthwise dimensions of the head.

13. The security device of claim 9, wherein the hasp hardware includes a washer abutting the head and fitted onto the shaft, the washer having a widthwise dimension that is wider than the head.

14. A security device to deter catalytic converter theft, comprising:

a plurality of components that are configured and arranged to provide redundant layers of mutual protection as a deterrent against catalytic converter theft, the components including a flexible wire mesh cage, at least one hasp, hasp hardware, at least one frame chain, and frame hardware, the flexible cage having a central cylindrical region and two tapering regions, the two tapering regions terminating at opposite ends respectively, the flexible cage being of wire mesh and having two bends transitioning the central cylindrical region to respective ones of the two tapering regions, the hasp hardware and the frame hardware each including at least one shoulder bolt having a head and a shaft and at least one shear nut connected to an end of the shaft, the at least one frame chain being connected to the shaft of the shoulder bolt of the hasp hardware and to the shaft of the shoulder bolt of the frame hardware, wherein the hasp includes a tube and two plates extending from the tube, the hasp hardware including a shackle of a padlock that extends from outside the tube to within the tube, the at least one frame chain being secured to the shackle outside of the tube.

15. A security device to deter catalytic converter theft, comprising:

a plurality of components that are configured and arranged to provide redundant layers of mutual protection as a deterrent against catalytic converter theft, the components including a flexible wire mesh cage, at least one hasp, hasp hardware, at least one frame chain, and frame hardware, the flexible cage having a central cylindrical region and two tapering regions, the two tapering regions terminating at opposite ends respectively, the flexible cage being of wire mesh and having two bends transitioning the central cylindrical region to respective ones of the two tapering regions, the hasp hardware and the frame hardware each including at least one shoulder bolt having a head and a shaft and at least one shear nut connected to an end of the shaft, the at least one frame chain being connected to the shaft of the shoulder bolt of the hasp hardware and to the shaft of the shoulder bolt of the frame hardware, a catalytic converter, the flexible cage being wrapped around the catalytic converter, the tapering regions of the flexible cage being in a relative location that blocks the catalytic converter from being able to slide through either of the opposite ends of the flexible cage.

* * * * *